United States Patent [19]

Reider

[11] 4,158,949

[45] Jun. 26, 1979

[54] SEGMENTED ANNULAR COMBUSTOR

[75] Inventor: Samuel B. Reider, Indianapolis, Ind.

[73] Assignee: General Motors Corporation, Detroit, Mich.

[21] Appl. No.: 854,758

[22] Filed: Nov. 25, 1977

[51] Int. Cl.[2] ..... F02C 7/18; F02C 7/20

[52] U.S. Cl. ..... 60/39.32; 60/39.65; 60/39.69 R

[58] Field of Search ..... 60/39.32, 39.65, 39.69 R; 431/351, 352

[56] References Cited

U.S. PATENT DOCUMENTS

| | | | |
|---|---|---|---|
| 2,544,538 | 3/1951 | Mahnken et al. | 60/39.69 |
| 2,651,912 | 9/1953 | Abbott | 60/39.65 |
| 2,919,549 | 1/1960 | Haworth et al. | 60/39.65 |
| 3,031,844 | 5/1962 | Tomolonius | 60/39.69 |
| 3,623,711 | 11/1971 | Thorstenson | 60/39.65 |
| 3,956,886 | 5/1976 | Sedgwick | 60/39.32 |

*Primary Examiner*—Robert E. Garrett

*Attorney, Agent, or Firm*—J. C. Evans

[57] ABSTRACT

An industrial gas turbine engine includes an inclined annular combustor made up of a plurality of support segments each including inner and outer walls of trapezoidally configured planar configuration extents and including side flanges thereon interconnected by means of air cooled connector bolt assemblies to form a continuous annular combustion chamber therebetween and wherein an air fuel mixing chamber is formed at one end of the support segments including means for directing and mixing fuel within a plenum and a perforated header plate for directing streams of air and fuel mixture into the combustion chamber; each of the outer and inner walls of each of the support segments having a ribbed lattice with tracks slidably supporting porous laminated replaceable panels and including pores therein for distributing combustion air into the combustion chamber while cooling the inner surface of each of the panels by transpiration cooling thereof.

5 Claims, 7 Drawing Figures

SEGMENTED ANNULAR COMBUSTOR

The Government has rights to this invention pursuant to Contract No. E (49-18)-2290 awarded by the U.S. Department of Energy.

This invention relates to gas turbine engine combustor assemblies and more particularly to gas turbine engine combustor assemblies including replaceable segments joined together by means of connector bolt assemblies.

It is desirable to operate gas turbine engine combustor assemblies at elevated temperatures in order to reduce fuel consumption.

In such arrangements, the elevated temperature of operation can cause thermal erosion of component parts of the combustor assembly. Accordingly, it is desirable to form combustor assemblies to be easily inspected and of a configuration wherein segments of the combustion chamber wall can be replaced separately from other components. Furthermore, it is desirable that such replaceable components be easily assemblied during initial installation.

U.S. Pat. No. 3,031,844, issued May 1, 1962. to Tomolonius, discloses a split combustor liner having semi-circular parts joined together at flanged segments by connector bolts directed therethrough. The arrangement is characterized by having two outer axially directed flanged access plates that must be removed in order to gain access to an inner joint held together by means of a plurality of bolts and nuts.

In this arrangement the inner joint is exposed to high temperature operating conditions which can complicate separation of the connectors of the inner joint following periods of use. Furthermore, the walls use heavy gauge metal to form the component parts of the combustor assembly characterized by large diameter primary air openings into the interior thereof without transpiration cooling of the inner wall thereof. Each liner part including flanges, end channel and wall part must be replaced as a unit.

Accordingly, an object of the present invention is to provide an improved gas turbine engine combustor assembly including a plurality of liner wall support segments each having an outer wall and an inner wall and each including a ribbed lattice thereacross including tracks for removably supporting individual ones of a plurality of porous laminated panels and wherein each of the support segments have side flanges joined together by means of air cooled connectors at inner and outer joints having bolts therethrough accessible from points exterior of the combustor assembly.

Another object of the present invention is to provide an improved annular combustor assembly including segmented supports each having an outer wall and an inner wall, the outer and inner wall each having a ribbed lattice formed thereacross including tracks thereon for supportingly receiving a plurality of individual porous metal panels for directing air from annular outer and annular inner diffuser chambers into a combustion chamber formed between the inner and outer walls and wherein each of the porous metal panels are removably replaceable from the ribbed lattice of the inner and outer walls to repair thermally eroded portions without replacing the segmented supports of the gas turbine engine combustor assembly.

Still another object of the present invention is to provide an improved annular combustor assembly including a separate plurality of support segments each having an inner and outer wall with side flanges thereon connected to adjacent ones of the support segments by connector assemblies accessible from exteriorly of the combustor assembly, and each of the inner and outer walls having a ribbed lattice configuration thereon including tracks for supportingly receiving porous metal panels for directing air from exteriorly of the combustor to an annular combustion chamber therein to cool the inner walls of the liners by transpiration cooling thereof and wherein thermally eroded ones of the porous metal panels are replaceable within the combustor assembly without replacing the support segments thereof.

Still another object of the present invention is to provide a combustor assembly of the type set forth in the preceding object wherein a dome segment is connected to each of the support segments including a pair of circular front flanges thereon connected to mating circular flanges formed on one end of each of the outer and inner walls of each of the support segments and wherein the dome includes a perforated fuel supply tube located within an arcuate mixing chamber having air flow thereto; the mixing chamber being closed at one end thereof by a shower head air fuel distributor located at the inlet end of the combustion chamber and operated to direct a plurality of streams of mixed air and fuel into the combustion chamber for burning between the air cooled panels on each of the support segments.

Still another object of the present invention is to provide an improved industrial gas turbine engine combustor assembly including a plurality of support segments each having an outer wall and an inner wall and including means joining the inner and outer walls on each of the support segments together to form a continuous outer peripheral wall and a continuous inner peripheral wall around an annular combustion zone therebetween and wherein a dome is provided on the joined support segments to define a continuous circumferential air fuel plenum having means therein for directing and mixing air fuel together and including a perforated header plate to direct streams of the mixed air and fuel from the plenum into the combustion zone; each of the inner and outer walls of the support segment having a ribbed lattice thereon slidably supporting porous laminated panels to direct air from exteriorly of the inner and outer walls into the combustion zone for cooling the inner surface of the panels by transpiration cooling thereof and wherein each of the panels are removably replaceable from the support segments.

Further objects and advantages of the present invention will be apparent from the following description, reference being had to the accompanying drawings wherein a preferred embodiment of the invention is clearly shown.

Figure 1:
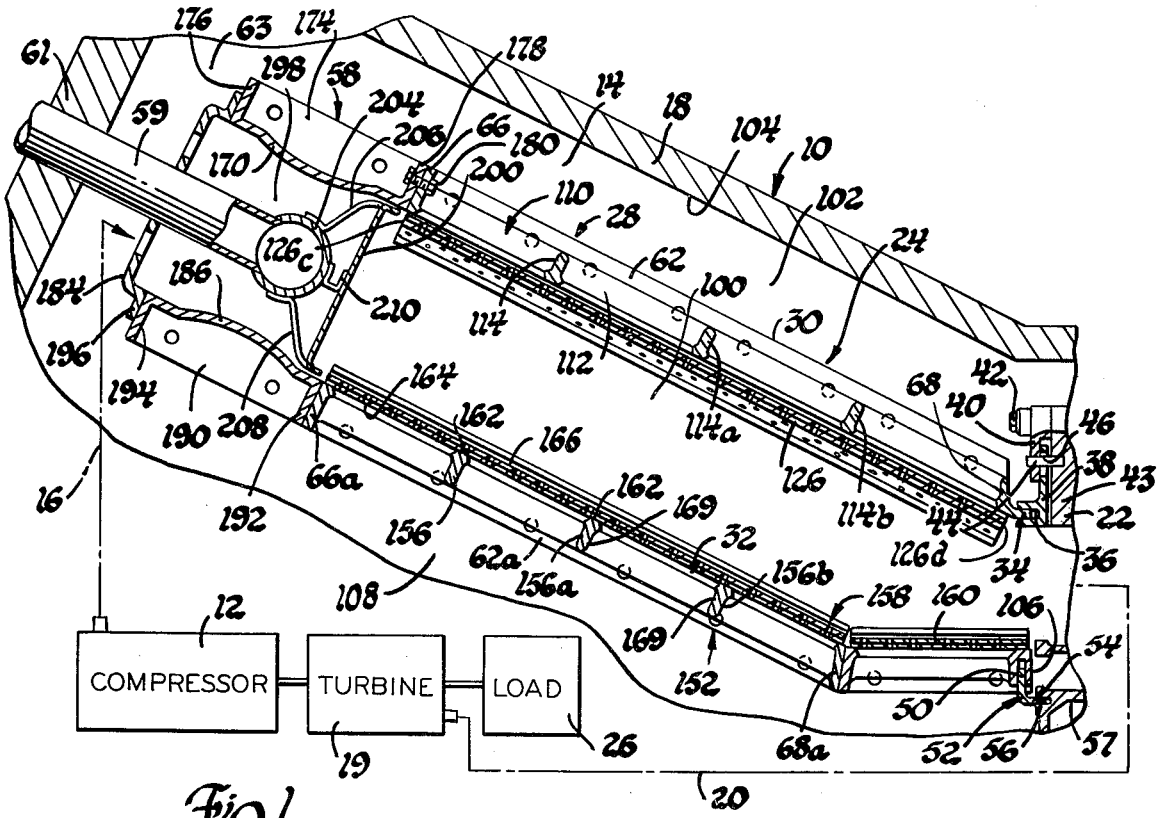
FIG. 1 is a longitudinal sectional view of a combustor in an industrial gas turbine engine.

Referring now to FIG. 1, an industrial gas turbine engine 10 is illustrated. It includes a compressor 12 for directing air into an annular plenum chamber 14 through a supply conduit 16. The plenum chamber 14 is bounded by a combustor wall 18, a section of which is shown in FIG. 1.

The compressor 12 is driven by a turbine 19 having exhaust gas directed therethrough from a conduit 20 in communication with an outlet 22 from a combustor assembly 24 constructed in accordance with the present invention. The turbine 18 drives a load 26 such as an electrical generator.

Figure 2:
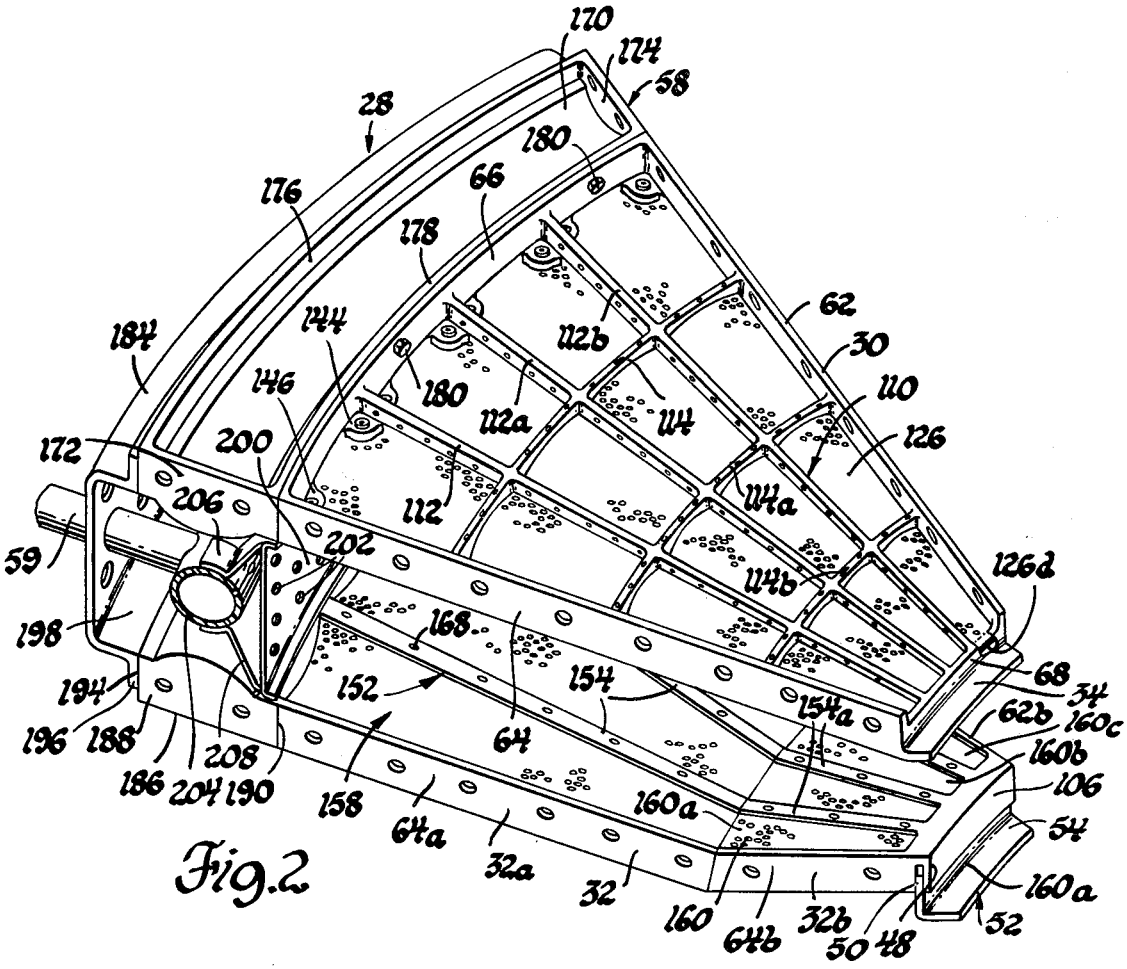
FIG. 2 is a view in perspective of a support segment of the combustor assembly in FIG. 1.

The combustor assembly 24 is made up of a plurality of support segments 28, one of which is illustrated in FIG. 2. Each of the support segments 28 includes an outer wall 30 and an inner wall 32 located generally parallel to one another. The outer wall, however, is of a continuous inclination and includes a lip segment 34 thereon supportingly received within a slot 36 of an annular support ring 38 held by means of an annular clamp 40 that is secured by bolt assemblies 42 to a wall 43.

The clamp 40 has a locator pin 44 secured thereto slidably received within a slot 46 in the ring 38 to compensate for radial expansion of the outer wall 30 with respect to the wall 43. Likewise, the lip 34 is free to expand axially within the slot 36 to compensate for axial growth of the outer wall 30.

The inner wall 32 includes an inclined segment 32*a* and a horizontal segment 32*b* as viewed in FIGS. 1 and 2. The horizontal segment 32*b* includes a channel end 48 supportingly receiving a vertical leg 50 of an angle member 52 having a horizontal leg 54 thereon supportingly received within an annular slot 56 of an outlet forming wall member 57 thereby to support the inner wall 32 for both radial and axial thermal expansion.

The opposite end of each support segment 28 is attached to a dome assembly 58 having a large diameter fuel supply pipe 59 directed thereto which is fixedly located by means of a wall member 61 having brackets 63 thereon secured to the dome assembly 58 for locating the opposite end of the combustor assembly 24 within the plenum 14. The dome assembly end of the combustor 24 thereby is fixed and the component parts of each of the support segments 28 will thermally expand therefrom and be compensated by the aforedescribed structure at the outlet 22.

In accordance with certain principles of the present invention, each outer wall 30 includes a pair of radially outwardly directed side flanges 62, 64 joined at one end thereof by a cross flange 66 and at the opposite end thereof by a cross flange 68 which is of lesser width than the cross flange 66. As a result, the side flanges 62, 64 converge with respect to one another from the domed end of the support segment 28 to the outlet end thereof as is best shown in FIG. 2. The side flanges 62, 64 and cross flanges 66, 68 thereby define a perimeter on the outer wall 30 that bounds a generally trapezoidally configured planar extent therebetween.

The inner wall 32 likewise includes side flanges 62*a* and 64*a* joined at one end thereof by a wide cross flange 66*a* and at the opposite end thereof by a narrower cross flange 68*a* so that the portion 32*a* of the inner wall 32 has a like trapezoidally configured planar extent. Likewise, the segment 32*b* of the inner wall 32 has side flanges 62*b* and 64*b* that merge with the outlet channel 48 to define a planar extent of trapezoidal form in the horizontal.

Figure 4:
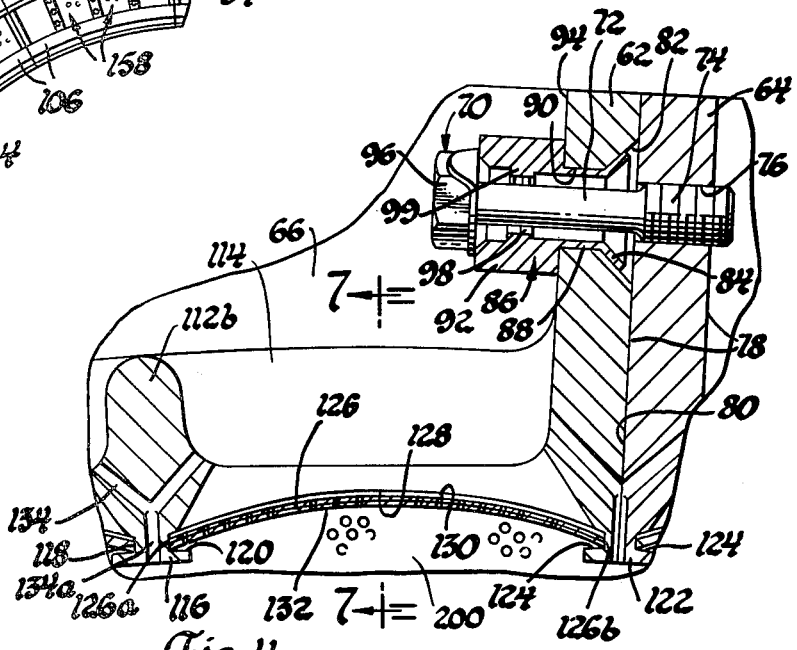
FIG. 4 is an enlarged, fragmentary vertical sectional view taken along the lines 4—4 of FIG. 3 looking in the direction of the arrows.

Each of the side flanges 62, 62*a*, 62*b* and 64, 64*a* and 64*b* are joined together with adjacent ones of such flanges by means of air cooled connector bolt assemblies 70 as shown in FIG. 4. Each such connector bolt assembly 70 includes a bolt 72 having its threaded portion 74 threadably received in a threaded bore 76 of one of the flanges 64. The adjacent flange 62 of one of the support segments has an inside surface 78 thereon juxtaposed against an inside surface 80 of the flange 64. The surface 78 includes a countersunk recess 82 therein defining a support surface for the flared skirt 84 of a tubular washer 86 including a tubular midsegment 88 thereon supported within a bore 90 of the wall 62 and including a larger diameter tubular outboard end 92 thereon that bears against the exposed surface 94 of the flange 62 at one end thereof and against the head 96 of the bolt 72 at the opposite end thereof. A threaded surface 98 is carried by a radially inwardly directed annular rib 99 interiorly of the washer 86 to supportingly receive the bolt 72 during its assembly and to serve as a thermal barrier therebetween. When the bolt 72 is threaded into the threaded bore 76 it will hold the washer 86 tightly in place. Thermal growth of the flanges 62, 64 will be compensated by the flared skirt 84 and the countersunk recess 82.

Figure 3:
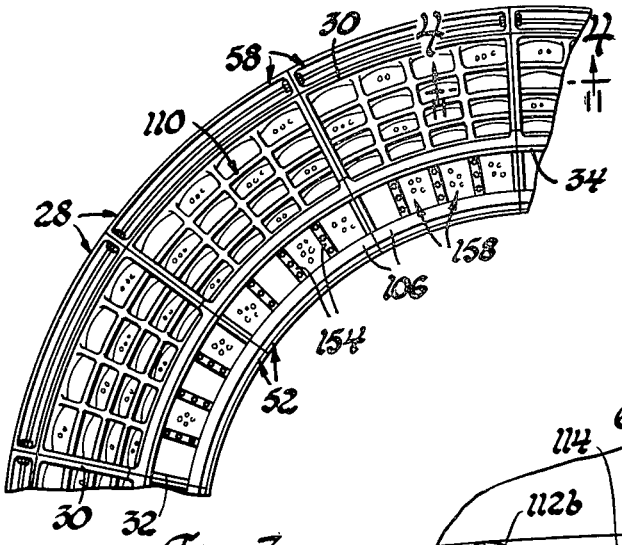
FIG. 3 is a fragmentary, end elevational view of an outer wall portion of the combustor assembly shown in FIG. 1.

The joined support segments 28 form an annular combustion chamber therebetween, a fragment of which is shown in FIG. 3 and a longitudinal section of which is shown in FIG. 1. As shown in FIG. 3, the lip portion 34 of each of the separate support segments 28 are joined together to form an annular ring around the outer periphery of outlet 22 from a combustion chamber 100. Each of the outer walls 30 are joined together to form a radially outwardly flared wall configuration up to the dome assembly 58 from the outlet 22 and defines the inside of an annular portion 102 of the plenum chamber 14 bounded on the outside by the inner surface 104 of the combustor wall 18 and by the outer wall member 30.

Likewise, the horizontal segment 32*b* of the inner wall includes an axially facing aft end 106 thereon that is formed as a continuous circumference with adjacent like surfaces 106 to define the outer boundary of the outlet 22 from the combustion chamber 100. The inner wall 32 is thereby formed as a continuous circle of wall segments that define a lower annular plenum space 108. In accordance with certain principles of the present invention each outer wall 30 includes a ribbed lattice 110 thereon including a plurality of longitudinally directed ribs 112, 112*a*, 112*b* and a plurality of cross ribs 114, 114*a*, and 114*b*. Each of the longitudinal ribs 112 through 112*b* has a dependent T-bar 116 thereon with opposed tracks 118, 120 formed therein. Additionally, each of the side flanges 62, 64 has an L-bar 122 dependent therefrom with a track 124 formed therein. Each of the tracks 124 faces one of the tracks 120 to define a longitudinal support. Tracks 118, 120 between ribs 112, 112*a* and 112*b* also define like longitudinal supports. A porous laminated panel 126 that is slidably removable from each of the opposed tracks 120, 124 and each of the tracks 118, 120. The tracks are formed continuously from the cross flange 66 at the dome 58 to the cross flange 68 at the outlet 22 and are configured to converge toward one another in the direction of the outlet 22. Each panel 126 is configured as an elongated trapezoidal member to slidably fit within the aforesaid tracks.

The cross ribs 114, 114*a*, 114*b* each has a plurality of concavely formed inner surfaces 128 thereon that back each of the panels 126. Each panel 126 is bowed between side edges 126*a*, 126*b* thereon to form a curved outer surface 130 that conforms to the surface 128 to reinforce the porous panel 126 between opposite axial ends 126*c* and 126*d* thereon. The bowed configuration of the panel 126 reinforces it against pressure differentials from the annular plenum 102 into the combustion chamber 100.

The track support arrangement for each of the individual panels 126 enables them to be removably supported in the combustor assembly 24 without requiring replacement of the full combustor apparatus and without separation of the individual support segments 28 from one another. Removal in the illustrated arrangement is made by disconnecting the wall 43 and annular support ring 38 from the lip segment 34 on the outer wall 30.

The provision of the porous panels 126 in the outer wall 30 allows a controlled flow of inlet air from the plenum 102 into the combustion chamber 100 for combustion with air and fuel mixtures from the dome assembly 58. Examples of a suitable laminated porous metal for use in each of the panels 126 is set forth in U.S. Pat. No. 3,584,972 issued June 15, 1971, to Bratkovich et al. The porous laminated metal configuration set forth in the aforesaid patent produces transpiration cooling of the inside surface 132 of each of the panels 126 so that the combustor apparatus 24 can be operated at elevated temperature conditions. Furthermore, each of the longitudinal ribs 112–112*b* includes axially spaced Y-configured air cooling passages 134 to direct cooling air through a radially inwardly directed segment 134*a* between each of the tracks 118, 120 on the T-bars 116 to further reduce temperatures of the support structure for the individual panels 126.

Figure 5:
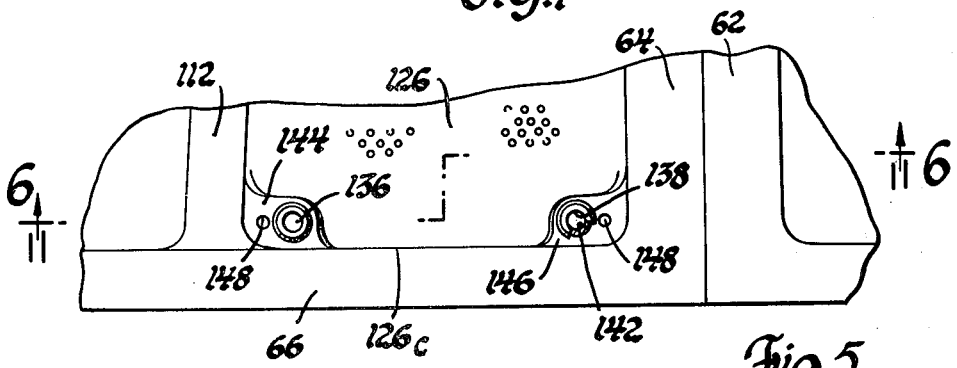
FIG. 5 is a fragmentary planar view of connector elements in the combustor assembly of FIG. 1.

In the illustrated arrangement each of the panels 126 is secured in place by means representatively shown in FIG. 5 as including a pair of spaced hollow rivets 136, 138 directed through bores 140, 142 respectively in a lock boss 144, 146 formed in each of the corners between the head flange 66 and the adjacent side flanges 62, 64 or longitudinal ribs 112 through 112*b*. Air flow through the hollow rivets 136, 138 cools the connection between the porous metal material of the panels 126 and the underlying support.

Figure 6:
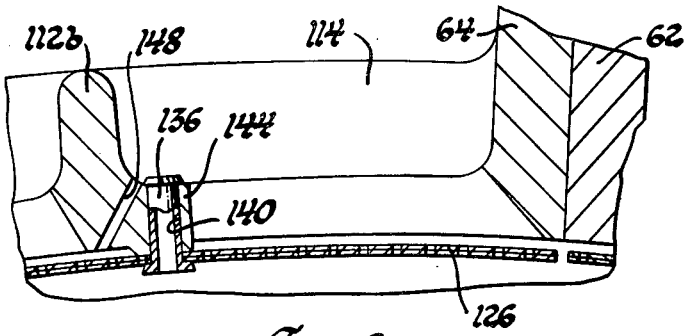
FIG. 6 is a vertical sectional view taken along the line 6—6 of FIG. 5 looking in the direction of the arrows.

As shown in FIG. 6, further cooling is provided by an inclined passage 148 formed in the longitudinal ribs 112–112*b* adjacent each of the rivets 136, 138.

Figure 7:
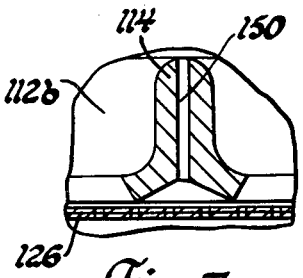
FIG. 7 is a fragmentary vertical sectional view taken along the line 7—7 of FIG. 4.

Furthermore, each of the cross ribs 114–114*b* includes a plurality of vertically directed cooling passages 150, one of which is shown in FIG. 7 to further cool the support structure for the individual panels 126.

The inner wall 32 includes a ribbed lattice 152 configured like the ribbed lattice 110 of the outer wall 30. FIG. 2 shows the inner wall of a plurality of longitudinal ribs 154 each having a horizontal segment 154*a* thereon extending across the horizonal portion 32*b* of the inner wall 32. As shown in FIG. 1, each of the longitudinal ribs 154 is joined by a cross rib 156, 156*a*, 156*b*. As in the case of the ribs 112–112*b*, the longitudinal ribs 154 have side tracks formed therein corresponding to those illustrated in FIG. 4. The tracks support porous metal laminated panels 158 between flanges 66*a* and 68*a* and further support a second plurality of porous metal laminated panels 160 through 160*c* in facing tracks formed on the longitudinal ribs 154*a* between the flange 68*a* and end channel 48 of the inner wall portion 32*a*. Each of the cross ribs 156, 156*a*, 156*b* has a concavely formed inner surface 162 thereon that has the same curvature as a curved surface 164 on each of the panels 158 to maintain a bowed shape which reinforces the panel, as in the first case, against pressure differentials thereacross between plenum 108 and combustion chamber 100. The porous panels in the inner wall 32 serve as a means for directing combustion air from the inner annular plenum space 108 into the combustion chamber 100 and cools the inner surfaces 166 of each of the panels for higher temperature operation thereof.

The inner wall panels are separated by removing the wall portion 32*b* from the combustion apparatus 24 to obtain access to the panels 160 through 160*c* thereon. When the panel portion 32*b* is removed each of the individual panels 158 on wall 32 can be removed from the inclined segment of the ribbed lattice 152.

Coolant passages corresponding to those shown in the outer wall 30 are provided in the inner wall 32. Thus, each of the ribs 154 includes a Y-configured cooling passage 168 therein like the Y-configured cooling passages 134 in the first embodiment. Furthermore, each of the cross ribs includes a plurality of vertical passages 169 therein corresponding to the passages 150. Passages like cooling passages 148 in FIG. 6 are provided in the corners of the panel supports in the inner wall 32.

The air fuel supply for the combustor assembly 24 is made up of a plurality of the dome assemblies 58 on the individual support segments 28. More particularly, each of the dome assemblies 58 includes an outer arcuate wall 170 with a pair of side flanges 172, 174 thereon connected to adjacent like flanges on the adjacent support segment 28 as shown in FIG. 3 to form a continuous outer circular wall at the dome assemblies 58. The outer wall 170 further includes a plurality of side walls 176, 178. The wall 178 is connected by suitable fasteners 180 to the flange 66. The wall 176 is connected to an air distribution cover 184 on the end of each of the dome assemblies 58.

The dome assemblies 58 each further includes an inner wall 186 with side flanges 188, 190 joined together by suitable fastener means to form a continuous wall around the dome assemblies 58. Furthermore, they include an inboard flange 192 and an outboard flange 194 connected respectively to the cross flange 66*a* of the inner wall 32 and a flange 196 of the air distribution cover 184 as is best shown in FIG. 1. The inner and outer walls 170, 186 and air distribution cover 184 together from a mixing chamber 198 leading to a perforated head plate 200 with a plurality of small diameter orifices 202 therein for distributing air and fuel mixture from within the chamber 198 as a plurality of longitudinally directed, fine streams into the uppermost end of the combustion chamber 100. In the illustrated arrangement, fuel supplied to the mixing chamber 198 is through the fuel supply pipes 59 which communicate with a perforated annular fuel distributing ring 204 that is supported by means of upper and lower braces 206, 208 and a side brace 210 is spaced relationship to the plate 200. The fuel supply pipe 59 directs gas into ring 204. Gas therefrom flows into chamber 198 where it is thoroughly mixed with air prior to passage through the head plate 200 to produce improved combustion of fuel within the chamber 100 during operation thereof at elevated temperature conditions made possible by means of the replaceable porous metal panels and support arrangement of the present invention.

While the embodiments of the present invention, as herein disclosed, constitute a preferred form, it is to be understood that other forms might be adopted.

The embodiments of the invention in which an exclusive property or privilege is claimed are defined as follows:

1. A gas turbine engine combustor assembly comprising a plurality of support segments each including an outer wall and an inner wall, means joining said support segments to one another to form a continuously peripheral outer liner and inner liner defining an annular combustion zone therebetween, means for mixing and directing air and fuel into said combustion zone, each of said outer and inner walls having a ribbed lattice with longitudinal ribs and cross ribs defining panel supports around said combustion zone, said longitudinal ribs of said lattice having tracks formed therein, porous laminated panels slidably supported within said tracks for removable insertion therein, each of said panels serving to direct air from exteriorly of said outer and inner walls for cooling the inner surface of said outer and inner walls by transpiration cooling thereof.

2. A gas turbine engine combustor assembly comprising a plurality of support segments each including an outer wall and an inner wall, means joining said support segments to one another to form a continuously peripheral outer liner and inner liner defining an annular combustion zone therebetween, means for mixing and directing air and fuel into said combustion zone, each of said outer and inner walls having a ribbed lattice with longitudinal ribs and cross ribs defining panel supports around said combustion zone, said longitudinal ribs of said lattice having tracks formed therein, porous laminated panels slidably supported within said tracks for removable insertion therein, each of said panels serving to direct air from exteriorly of said outer and inner walls for cooling the inner surface of said outer and inner walls by transpiration cooling thereof, each of said panels being bowed outwardly of said combustion zone between said tracks to reinforce said panels against pressure differentials thereacross, each of said cross ribs having a curvature congruous with said panels and contacting said panels along their lengths for further reinforcement thereof.

3. A gas turbine engine combustor assembly comprising a plurality of support segments each including an outer wall and an inner wall, means joining said support segments to one another to form a continuously peripheral outer liner and inner liner defining an annular combustion zone therebetween, a dome on each of said joined support segments for forming an air fuel plenum upstream of said combustion zone, means for directing and mixing air and fuel within said plenum, a perforated header plate separating said plenum from said combustion zone for injecting streams of air and fuel mixture from said plenum into said combustion zone, each of said outer and inner walls having a ribbed lattice with longitudinal ribs and cross ribs defining panel supports around said combustion zone, said longitudinal ribs of said lattice having tracks formed therein, porous laminated panels slidably supported within said tracks for removable insertion therein, each of said panels serving to direct air from exteriorly of said outer and inner walls for cooling the inner surface of said outer and inner walls by transpiration cooling thereof.

4. A gas turbine engine combustor assembly comprising a plurality of support segments each including an outer wall and an inner wall, means joining said support segments to one another to form a continuously peripheral outer liner and inner liner defining an annular combustion zone therebetween, a dome on each of said joined support segments for forming an air fuel plenum upstream of said combustion zone, means for directing and mixing air and fuel within said plenum, a perforated header plate separating said plenum from said combustion zone for injecting streams of air and fuel mixture from said plenum into said combustion zone, each of said outer and inner walls having a ribbed lattice with longitudinal ribs and cross ribs defining panel supports around said combustion zone, said longitudinal ribs of said lattice having tracks formed therein, porous laminated panels slidably supported within said tracks for removable insertion therein, each of said panels serving to direct air from exteriorly of said outer and inner walls for cooling the inner surface of said outer and inner walls by transpiration cooling thereof, each of said panels being bowed outwardly of said combustion zone between said tracks to reinforce said panels against pressure differentials thereacross, each of said cross ribs having a curvature congruous with said panels and contacting said panels along their lengths for further reinforcement thereof.

5. An industrial gas turbine engine combustor assembly comprising a plurality of support segments each including an outer wall and an inner wall, means joining said support segments to one another to form a continuously peripheral outer liner and inner liner defining an annular combustion zone therebetween with an axial outlet, said liners being inclined upwardly from said axial outlet, a dome on each of said joined supports for forming an air fuel plenum upstream of said combustion zone, means for directing and mixing air and fuel within said plenum, a perforated header plate separating said plenum from said combustion zone for injecting streams of air and fuel mixture from said plenum into said combustion zone, each of said outer and inner walls having a ribbed lattice defining panels exteriorly of said combustion zone, said lattice having longitudinal ribs with tracks formed therein, porous laminated panels slidably supported within said tracks for removable insertion therein, each of said panels serving to direct air from exteriorly of said outer and inner walls for cooling the inner surface of said outer and inner walls by transpiration cooling thereof.

* * * * *